US010522127B2

(12) United States Patent
Yamamoto

(10) Patent No.: US 10,522,127 B2
(45) Date of Patent: Dec. 31, 2019

(54) CONVERSION-TO-NOTE APPARATUS, ELECTRONIC WIND INSTRUMENT AND CONVERSION-TO-NOTE METHOD

(71) Applicant: CASIO COMPUTER CO., LTD., Shibuya-ku, Tokyo (JP)

(72) Inventor: Kazuto Yamamoto, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/136,154

(22) Filed: Sep. 19, 2018

(65) Prior Publication Data

US 2019/0096377 A1 Mar. 28, 2019

(30) Foreign Application Priority Data

Sep. 27, 2017 (JP) ..... 2017-185924

(51) Int. Cl.
*G10H 7/00* (2006.01)
*G10H 1/02* (2006.01)

(52) U.S. Cl.
CPC ..... *G10H 7/002* (2013.01); *G10H 1/02* (2013.01); *G10H 2250/461* (2013.01)

(58) Field of Classification Search
CPC .. G10H 1/00; G10H 1/38; G10H 3/16; G10H 7/00; G10H 2210/571; G10H 2230/205; G10H 1/186; G10H 2220/275; G10H 2250/465; G10H 2250/621; G10H 2230/155; G10H 2240/125; G10C 3/12; G10G 1/02
See application file for complete search history.

(56) References Cited

U.S. PATENT DOCUMENTS 5,929,361 A 7/1999 Tanaka
6,002,080 A 12/1999 Tanaka
2007/0017346 A1* 1/2007 Masuda ..... G10H 1/053 84/600
2007/0017352 A1* 1/2007 Masuda ..... G10H 1/053 84/658

(Continued)

FOREIGN PATENT DOCUMENTS

JP 2015084027 A 4/2015

OTHER PUBLICATIONS

Extended European Search Report (EESR) dated Nov. 27, 2018 issued in counterpart European Application No. 18196413.1.

(Continued)

*Primary Examiner* — Marlon T Fletcher
(74) *Attorney, Agent, or Firm* — Holtz, Holtz & Volek PC

(57) ABSTRACT

A conversion-to-note apparatus includes: a key which is operated by a user; and a processor. The processor obtains, from a memory, first information and second information. The first information is information to associate a key operation on the key with an open/close state of a tone hole or virtual tone hole. The second information is information to associate the open/close state of the tone hole or virtual tone hole with a note. Further, the processor identifies, based on the first information, the open/close state of the tone hole or virtual tone hole for the key operation detected. Further, the processor determines, based on the second information, the note for the identified open/close state of the tone hole or virtual tone hole.

15 Claims, 5 Drawing Sheets

(56) References Cited

U.S. PATENT DOCUMENTS

2007/0068372 A1* 3/2007 Masuda ..... G10H 1/0008
84/723

OTHER PUBLICATIONS

Anonymous, "Aerophone AE-10 Owner's Manual", Jan. 1, 2016, XP055521839, Retrieved from Internet, https://static.roland.com/assets/media/pdf/AE-10_eng03_W.pdf>, pp. 7-11.

* cited by examiner

FIG.2

93

| | VIRTUAL TONE HOLE 12 | VIRTUAL TONE HOLE 11 | VIRTUAL TONE HOLE 10 | VIRTUAL TONE HOLE 9 | VIRTUAL TONE HOLE 8 | VIRTUAL TONE HOLE 7 | VIRTUAL TONE HOLE 6 | VIRTUAL TONE HOLE 5 | VIRTUAL TONE HOLE 4 | VIRTUAL TONE HOLE 3 | VIRTUAL TONE HOLE 2 | VIRTUAL TONE HOLE 1 |
|---|---|---|---|---|---|---|---|---|---|---|---|---|
| FINGERING KEY No.1 | X | X | X | X | X | X | X | X | X | X | X | 0 |
| FINGERING KEY No.2 | X | X | X | X | X | X | X | X | X | X | 0 | X |
| FINGERING KEY No.3 | X | X | X | X | X | X | X | X | X | 0 | X | X |
| FINGERING KEY No.4 | X | X | X | X | X | X | X | 0 | 0 | X | X | X |
| FINGERING KEY No.5 | X | X | X | X | X | X | 0 | X | X | X | X | X |
| FINGERING KEY No.6 | X | X | X | X | X | 0 | X | X | X | X | X | X |
| FINGERING KEY No.7 | X | X | X | X | 0 | X | X | X | X | X | X | X |
| FINGERING KEY No.8 | X | X | X | 0 | X | X | X | X | X | X | X | X |
| FINGERING KEY No.9 | X | X | 1 | X | X | X | X | X | X | X | X | X |
| FINGERING KEY No.10 | X | 1 | X | X | X | X | X | X | X | X | X | X |
| FINGERING KEY No.11 | 1 | X | X | X | X | X | X | X | X | X | X | X |
| FINGERING KEY No.12 | 1 | 1 | X | X | X | X | X | X | X | X | X | X |

FIG.3

94

| | VIRTUAL TONE HOLE 9 | VIRTUAL TONE HOLE 8 | VIRTUAL TONE HOLE 7 | VIRTUAL TONE HOLE 6 | VIRTUAL TONE HOLE 5 | VIRTUAL TONE HOLE 4 | VIRTUAL TONE HOLE 3 | VIRTUAL TONE HOLE 2 | VIRTUAL TONE HOLE 1 |
|---|---|---|---|---|---|---|---|---|---|
| NOTE 1 | 0 | 0 | 0 | 0 | 0 | 0 | 0 | 0 | 0 |
| NOTE 2 | 0 | 0 | 0 | 0 | 0 | 0 | 0 | 0 | 1 |
| NOTE 3 | 0 | 0 | 0 | 0 | 0 | 0 | 0 | 1 | 1 |
| NOTE 4 | 0 | 0 | 0 | 0 | 0 | 0 | 1 | 1 | 1 |
| NOTE 5 | 0 | 0 | 0 | 0 | 1 | 1 | 1 | 1 | 1 |
| NOTE 6 | 0 | 0 | 0 | 1 | 1 | 1 | 1 | 1 | 1 |
| NOTE 7 | 0 | 1 | 1 | 1 | 1 | 1 | 1 | 1 | 1 |
| NOTE 8 | 1 | 0 | 0 | 1 | 1 | 1 | 1 | 1 | 1 |

CONVERSION-TO-NOTE APPARATUS, ELECTRONIC WIND INSTRUMENT AND CONVERSION-TO-NOTE METHOD

CROSS-REFERENCE TO RELATED APPLICATIONS

This application is based upon and claims the benefit of priority from the prior Japanese Patent Application No. 2017-185924, filed on Sep. 27, 2017, the entire contents of which are incorporated herein by reference.

BACKGROUND OF THE INVENTION

1. Field of the Invention

The present invention relates to a conversion-to-note apparatus, an electronic wind instrument and a conversion-to-note method for converting operations in playing to notes of sounds to output.

2. Description of the Related Art

There is known an electronic wind instrument manufactured by reproducing an acoustic wind instrument, such as a saxophone, as an electronic instrument.

An acoustic wind instrument has a plurality of tone holes having default open/close states and a plurality of fingering keys which change the open/close states of the tone holes. A player operates the fingering keys, so that the open/close states of the tone holes are changed, and a sound(s) of a predetermined note(s) is output.

In such an acoustic wind instrument, not one but a plurality of combinations of fingering keys (fingering patterns) exist for generating/realizing the open/close states of tone holes to output a sound(s) of a note(s).

Hence, a user can play an acoustic wind instrument by choosing fingering patterns from among fingering patterns of various alternate fingerings in addition to basic fingering patterns according to his/her habit, fingering for a piece of music and so forth.

Meanwhile, an electronic wind instrument has no concept of tone holes because it outputs sounds which are electrically generated by detecting operations on fingering keys.

Such an electronic wind instrument adopts a method of preregistering correspondences each indicating which fingering pattern produces a sound of which note, and when outputting a sound on the basis of fingering, determining a note associated with a key input pattern indicating which fingering key(s) has been operated, and outputting a sound of the note. (Refer to, for example, JP 2015-084027 A.)

SUMMARY OF THE INVENTION

According to an aspect of the present invention, there is provided a conversion-to-note apparatus including: a key which is operated by a user; and a processor which obtains, from a memory, first information to associate a key operation on the key with an open/close state of a tone hole or virtual tone hole and second information to associate the open/close state of the tone hole or virtual tone hole with a note, identifies, based on the first information, the open/close state of the tone hole or virtual tone hole for the key operation detected, and determines, based on the second information, the note for the identified open/close state of the tone hole or virtual tone hole.

According to another aspect of the present invention, there is provided a conversion-to-note method for an apparatus to perform a control process including: detecting a key operation on a key; identifying, based on first information to associate the detected key operation with an open/close state of a tone hole or virtual tone hole, the open/close state of the tone hole or virtual tone hole for the detected key operation; and determining, based on second information to associate the open/close state of the tone hole or virtual tone hole with a note, the note for the identified open/close state of the tone hole or virtual tone hole.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention, wherein:

FIG. 2 shows an example of a virtual tone hole open/close state table according to the embodiment;

FIG. 3 shows an example of a virtual-tone-hole-and-note correspondence table according to the embodiment;

DETAILED DESCRIPTION OF THE PREFERRED EMBODIMENTS

Hereinafter, an embodiment of a conversion-to-note apparatus and an electronic wind instrument including the conversion-to-note apparatus of the present invention is described with reference to FIG. 1 to FIG. 5.

Although various technically preferred limitations for carrying out the present invention are imposed on the embodiment below, the technical scope of the present invention is not limited to the embodiment or drawings.

[Configurations of Conversion-to-Note Apparatus and Electronic Wind Instrument Including Conversion-to-Note Apparatus]

First, the overall configuration of an electronic wind instrument 100 according to this embodiment is described with reference to FIG. 1.

Figure 1:
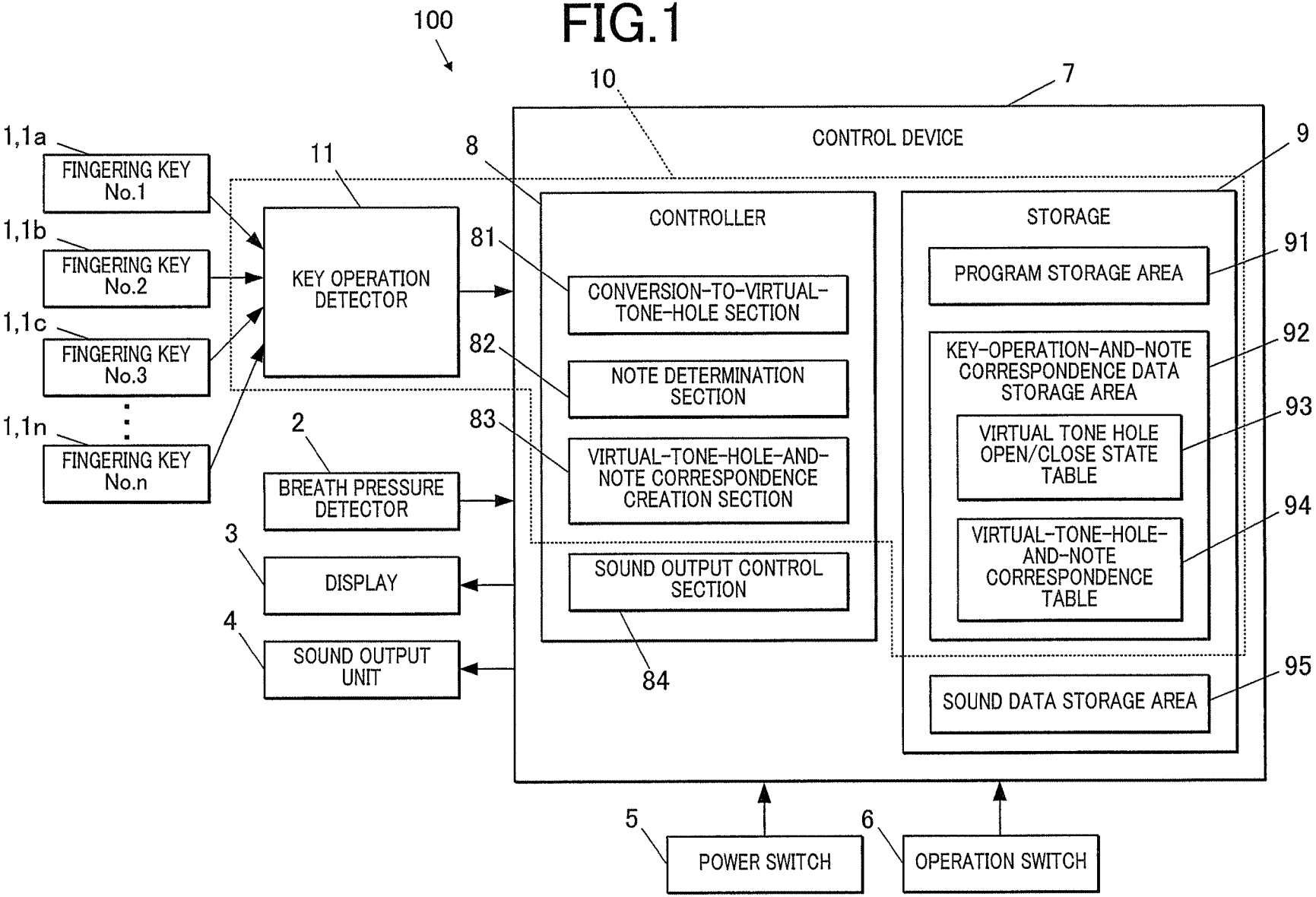
FIG. 1 is a block diagram showing main components of an electronic wind instrument including a conversion-to-note apparatus according to an embodiment.

FIG. 1 is a block diagram showing main components of the electronic wind instrument 100 according to this embodiment.

As shown in FIG. 1, the electronic wind instrument 100 of this embodiment includes a conversion-to-note apparatus 10, a breath pressure detector 2, a display 3, a power switch 5, an operation switch 6, and various components for outputting sounds (e.g. a sound output unit 4, a sound output control section 84, and a sound data storage area 95).

In FIG. 1, components constituting the conversion-to-note apparatus 10 are enclosed by a broken line.

The electronic wind instrument 100 of this embodiment also includes: a not-shown instrument body having a shape of an acoustic wind instrument (e.g. saxophone); and a plurality of fingering keys 1 (fingering keys 1*a* to in in FIG. 1) on the outer circumferential surface of the instrument body. The number and arrangement of the fingering keys 1 are the same as those of an acoustic wind instrument. The fingering keys 1 are provided with their respective key numbers (fingering keys no. 1 to no. n or simply keys no. 1 to no. n).

The instrument type of the electronic wind instrument 100 of this embodiment is not particularly limited, and the shape and so forth of the instrument body and the number, arrangement and so forth of the fingering keys 1 are appropriately determined according to an intended instrument type of an electronic wind instrument (saxophone, clarinet, flute, etc.).

The conversion-to-note apparatus 10 may be for one instrument type, or may have data and so forth for various instrument types and be configured to select data and so forth according to the instrument type of an electronic wind instrument in which the conversion-to-note apparatus 10 is installed, the data and so forth being used in processes.

The electronic wind instrument 100 also includes a key operation detector 11 as an operation detector which detects operations on the fingering keys 1.

The key operation detector 11 is, for example, a pressure sensor or a touch sensor which, when any of the fingering keys is pressed/operated by a user, detects this operation(s)/press(es).

The detection result by the key operation detector 11 (i.e. whether or not any of the fingering keys 1 has been operated, and if operated, which fingering key(s) 1 has been operated) is output to a control device 7. That is, the control device 7 detects operations on the fingering keys 1 via the key operation detector 11.

A not-shown mouthpiece is fitted to an end of the instrument body, and the breath pressure detector 2 is arranged in the instrument body near the mouthpiece.

The breath pressure detector 2 is a blowing pressure sensor (wind sensor) which detects a blowing pressure of user's (player's) breath (breath pressure) into the instrument body via the mouthpiece. The breath pressure detector 2 detects presence or absence of the breath, and also detects strength and speed (power) of the breath at least while the user is playing the electronic wind instrument 100.

In this embodiment, user's presses of the fingering keys 1 only do not fix operations on the fingering keys 1, but together with detection of the breath pressure by the breath pressure detector 2, fix operations on the fingering keys 1.

Thus, the breath pressure detector 2 functions as an operation fixing unit which fixes operations on the fingering keys 1.

In a state in which operations on the fingering keys 1 are fixed by detection of the breath pressure by the breath pressure detector 2 as the operation fixing unit, a conversion-to-virtual-tone-hole section 81 and a note determination section 82, both described below, convert the operations on the fingering keys 1 detected by the key operation detector 11 to the open/close states of imaginary tone holes and determine a note (s) (a pitch (es)) therefrom.

In order to fix operations on the fingering keys 1, user's breath into the instrument body is necessary. This can prevent user's unintended operation of the electronic wind instrument 100 from occurring when, the user presses wrong fingering keys 1 or presses the fingering keys 1 by mistake. Further, this fixation of operations on the fingering keys 1 by detection of the breath pressure allows a user to play the electronic wind instrument 100 with a feeling similar to that the user can have when he/she plays an acoustic wind instrument because an acoustic wind instrument also outputs sounds by user's breath thereinto.

The detection result by the breath pressure detector 2 is output to the control device 7. That is, the control device 7 detects the breath pressure via the breath pressure detector 2.

The display 3 is arranged on the outer circumferential surface or the like of the instrument body.

The display 3 displays various instruction screens and so forth.

In this embodiment, as described below, in a virtual-tone-hole-and-note correspondence data creation process, the display 3 displays and shows a user a note which is a target for association with virtual tone holes.

On the outer circumferential surface or the like of the instrument body, the power switch 5 for turning on and off a not-shown power source, the operation switch 6 as an operation unit for inputting various operations, and so forth are also arranged.

The operation switch 6 generates various switch events. The switch events generated by the operation switch 6 are output to the control device 7.

In this embodiment, an input operation on the operation switch 6 is a trigger to start the virtual-tone-hole-and-note correspondence data creation process described below.

The electronic wind instrument 100 includes the sound output unit 4 as a component for outputting sounds.

The sound output unit 4 includes: a D/A converter which convers sound data generated by the control device 7 to analog musical tone signals and outputs the musical tone signals; an amplifier which amplifies the musical tone signals; and a speaker which emits sounds based on the amplified musical tone signals.

The sound output unit 4 may include an output terminal or the like for outputting the sounds based on the musical tone signals to a headphone or the like.

The control device 7 is a computer which includes a controller 8 and a storage 9. The controller 8 is constituted of a not-shown CPU (Central Processing Unit). The storage 9 is constituted of a ROM (Read Only Memory), a RAM (Random Access Memory) and so forth (all not shown).

The storage 9 includes a program storage area 91 which stores, for example, various programs for operating the conversion-to-note apparatus 10 and the electronic wind instrument 100 including the conversion-to-note apparatus 10.

In this embodiment, the program storage area 91 stores, for example, a program for performing the virtual-tone-hole-and-note correspondence data creation process and a program for outputting musical tones.

In this embodiment, the storage 9 also includes a key-operation-and-note correspondence data storage area 92.

The key-operation-and-note correspondence data storage area 92 is a correspondence storage which stores first information to associate operations on the fingering keys 1 with open/close states of imaginary tone holes (virtual tone holes) and second information to associate the open/close states of the virtual tone holes with notes.

In this embodiment, the key-operation-and-note correspondence data storage area 92 stores a virtual tone hole open/close state table 93 as the first information and a virtual-tone-hole-and-note correspondence table 94 as the second information.

The virtual tone hole open/close state table 93 as the first information shows, for each of pairs (combinations) of the fingering keys 1 and the tone holes (virtual tone holes in this embodiment), which of an open state, a close state and a dependent open/close state should be the open/close state of the tone hole in a pair if a fingering key 1 in the pair is operated, wherein the dependent open/close state indicates the state in which the tone hole is in the open state or the close state depending on an operation on another fingering key 1.

FIG. 2 shows an example of the virtual tone hole open/close state table 93.

In FIG. 2, with respect to the fingering keys 1 (fingering keys no. 1 to no. 12 in FIG. 2 or simply keys no. 1 to no. 12) and the virtual tone holes 1 to 12, the open/close states of the virtual tone holes 1 to 12 when each fingering key 1 is operated are specified.

In FIG. 2, "0" indicates that a virtual tone hole is closed by an operation on a fingering key 1 shown in the left column of the virtual tone hole open/close state table 93, "1" indicates that a virtual tone hole is opened by an operation on a fingering key 1 shown in the left column thereof, and "x" indicates that a virtual tone hole is not affected by an operation on a fingering key 1 shown in the left column thereof. Hence, the open/close state of a virtual tone hole indicated by "x" depends on an operation on another fingering key 1 (a default open/close state predetermined for the virtual tone hole if the virtual tone hole is neither opened nor closed by an operation(s) on any of the fingering keys 1).

For example, if the fingering key 1 having the "key no. 1" is operated, this operation switches the virtual tone hole 1 to the close state from the open state which is its default open/close state.

An operation on one fingering key 1 may affect a plurality of virtual tone holes. For example, if the fingering key 1 having the "key no. 4" is operated, this operation switches the virtual tone holes 4 and 5 to the close state from the open state which is their default open/close state.

The number of fingering keys and the number of virtual tone holes specified in the virtual tone hole open/close state table 93 are not limited to those shown in the drawings, and all the fingering keys 1 arranged on the electronic wind instrument 100 and all the tone holes which are expected to have according to the instrument type of the electronic wind instrument 100 are specified in the virtual tone hole open/close state table 93.

FIG. 3 shows an example of the virtual-tone-hole-and-note correspondence table 94.

In FIG. 3, "0" indicates that a virtual tone hole is in the close state, and "1" indicates that a virtual tone hole is in the open state.

For example, a case (pattern) where all the virtual tone holes are in the close state is associated with a sound of a note 1 as a note the sound of which should be output. As another example, a case (pattern) where only the virtual tone holes 7 and 8 are in the close state is associated with a sound of a note 8 as the note, the sound of which should be output.

In this embodiment, the virtual-tone-hole-and-note correspondence table 94 as the second information can be created or edited by a virtual-tone-hole-and-note correspondence creation section 83 or the like.

The storage 9 also includes a sound data storage area 95.

The sound data storage area 95 stores waveform data (sound data) on notes of tone color (timbre) of the instrument type of the electronic wind instrument 100. The sound data may be synthetized mechanically, or may be generated, for example, by sampling sounds of an acoustic instrument.

The controller 8 functionally includes the conversion-to-virtual-tone-hole section 81, the note determination section 82, the virtual-tone-hole-and-note correspondence creation section 83, and the sound output control section 84. These functions as the conversion-to-virtual-tone-hole section 81, the note determination section 82, the virtual-tone-hole-and-note correspondence creation section 83, the sound output control section 84 and so forth are realized by the CPU of the controller 8 in cooperation with the programs stored in the program storage area 91 of the storage 9.

The conversion-to-virtual-tone-hole section 81 is a control section which converts operations on the fingering keys 1 detected by the key operation detector 11 to the open/close states of the virtual tone holes.

More specifically, the conversion-to-virtual-tone-hole section 81 determines the open/close states of the respective tone holes (virtual tone holes in this embodiment) on the basis of the open/close states stored, in the virtual tone hole open/close state table 93 as the first information, for the fingering key (s) 1 detected by the key operation detector 11, which is the operation detector, as being operated.

That is, if the key operation detector 11 detects an operation(s) on any of the fingering keys 1, the conversion-to-virtual-tone-hole section 81 reads the virtual tone hole open/close state table 93 as the first information from the key-operation-and-note correspondence data storage area 92, and obtains presence or absence of change in the open/close states of the respective virtual tone holes by the operation (s) on the fingering key(s) 1 and type of the change if the change is present, referring to the virtual tone hole open/close state table 93.

Hereinafter, a method for determining the open/close states of the respective tone holes (virtual tone holes in this embodiment) on the basis of an operation(s) on the fingering key(s) 1 performed by the conversion-to-virtual-tone-hole section 81 is described in detail.

If the key operation detector 11 detects that two or more fingering keys 1 have been operated, the conversion-to-virtual-tone-hole section 81 determines the open/close states of the respective tone holes (virtual tone holes in this embodiment) on the basis of change to the open state or the close state specified and stored, in the virtual tone hole open/close state table 93 as the first information, for any of the operated and detected fingering keys 1.

If the open/close state of any of the tone holes (virtual tone holes in this embodiment) stored, in the virtual tone hole open/close state table 93 as the first information, for each of all the operated and detected fingering keys 1 is the dependent open/close state, the conversion-to-virtual-tone-hole section 81 determines an open/close state(s) predetermined for the tone hole(s) as a state(s) to which the open/close state(s) of the tone hole(s) should be changed.

More specifically, the conversion-to-virtual-tone-hole section 81 recognizes the default open/close states of the respective virtual tone holes, and recognizes the open/close states of the respective virtual tone holes after an operation(s) on the fingering key(s) 1 on the basis of the default open/close states of the respective virtual tone holes and with reference to the virtual tone hole open/close state table 93.

For example, if only the fingering key 1 having the "key no. 1" is operated, only the virtual tone hole 1 is opened and the other virtual tone holes are not affected by the operation on this fingering key 1. Accordingly, their open/close states are unchanged. In this case, the conversion-to-virtual-tone-hole section 81 recognizes that the virtual tone holes 2 to 12 are in their default open/close states, and the virtual tone hole 1 is now in the open state.

In this embodiment, user's breath into the instrument body fixes operations on the fingering keys 1, and when the breath pressure detector 2 detects the breath pressure, the operations on all the fingering keys 1 being operated at the time of the detection are reflected in the open/close states of the virtual tone holes.

For example, if a user presses some of the fingering keys 1 successively and is pressing/operating the fingering keys 1 having the "key no. 1", "key no. 8" and "key no. 12" at the time the breath pressure is detected by the breath pressure detector 2, the conversion-to-virtual-tone-hole section 81 determines the open/close states of the virtual tone holes as follows: the virtual tone holes 1 and 9 are closed and the virtual tone holes 11 and 12 are opened due to the operations on the three fingering keys 1, and the other virtual tone holes remain in their default open/close states.

If a small amount of breath touching the instrument body can fix operations on the fingering keys 1, the electronic wind instrument 100 may misrecognize user's breath not for fixing the operations as breath for fixing the operations or may operate in a manner not intended by the user, for example Hence, it is preferable that the conversion-to-virtual-tone-hole section 81 fix operations on the fingering keys 1 when the breath pressure detector 2 detects the breath pressure of a predetermined threshold value or larger.

The note determination section 82 is a control section which determines a note (s) for the open/close states of the virtual tone holes to which operations on the fingering keys 1 have been converted by the conversion-to-virtual-tone-hole section 81.

If the conversion-to-virtual-tone-hole section 81 converts operations on the fingering keys 1 to the open/close states of the virtual tone holes, the note determination section 82 reads the virtual-tone-hole-and-note correspondence table 94 as the second information from the key-operation-and-note correspondence data storage area 92, and determines a note for the open/close states of the virtual tone holes as a note for the operations on the fingering keys 1, referring to the virtual-tone-hole-and-note correspondence table 94.

The virtual-tone-hole-and-note correspondence creation section 83 associates, if a note is specified and the fingering key(s) 1 is operated, the open/close states of the virtual tone holes for the operation(s) on the fingering key(s) 1 with the note.

The conversion-to-note apparatus 10 of the electronic wind instrument 100 of this embodiment has, in addition to a play mode, a correspondence setting mode in which correspondences between operations on the fingering keys 1 and notes of musical tones to be output by (in response to) the operations are set. If an operation to specify a note and an operation(s) on the fingering key(s) 1 are performed in this correspondence setting mode, the virtual-tone-hole-and-note correspondence creation section 83 associates the open/close states of the tone holes (virtual tone holes in this embodiment) with the specified note, thereby creating the virtual-tone-hole-and-note correspondence table 94 as the second information, wherein the operation(s) on the fingering key(s) 1 have been converted to the open/close states of the tone holes by the conversion-to-virtual-tone-hole section 81.

In the correspondence setting mode, a user can set and register desired fingering patterns for all notes in order which can be output by the electronic wind instrument 100 of this embodiment, starting from the lowest "do", for example.

The result of the correspondences between the virtual tone holes and the notes newly created by the virtual-tone-hole-and-note correspondence creation section 83 is stored in the key-operation-and-note correspondence data storage area 92 or the like as the virtual-tone-hole-and-note correspondence table 94.

If a virtual-tone-hole-and-note correspondence table 94 constituted of, for example, default settings, is already stored in the key-operation-and-note correspondence data storage area 92, the default settings or the like may be overwritten and updated by the newly created table, or both of them may be stored, for example, as a virtual-tone-hole-and-note correspondence table 94_1 and a virtual-tone-hole-and-note correspondence table 94_2 so that a user can choose a table to use when playing the electronic wind instrument 100.

The correspondences settable in the correspondence setting mode may be only for fingering patterns of alternate fingerings selectable in an acoustic wind instrument, but are not limited thereto.

For example, fingering patterns which do not exist (are not used) in an acoustic wind instrument may be set. More specifically, the open/close states of the virtual tone holes may be associated with each desired note, for example, such that an operation on one fingering key 1 can output one note. Such association (i.e. correspondences) allows novice wind instrument players, children and so forth to enjoy playing wind instruments casually.

Further, in the correspondence setting mode, correspondences between the virtual tone holes and notes do not need to be set for all the notes as described above. For example, only for notes the basic fingering patterns of which a user is not good at, fingering patterns different from the basic fingering patterns may be set and registered.

In this case, the newly set correspondences between the virtual tone holes and the notes combined with the default correspondences which have not been changed may be stored in the key-operation-and-note correspondence data storage area 92 or the like as a new virtual-tone-hole-and-note correspondence table 94 customized by the user, so that the user can choose and use this table 94 when playing the electronic wind instrument 100.

The sound output control section 84 causes the sound output unit 4 to output sounds of notes determined by the note determination section 82.

The sound output control section 84 obtains, in addition to a note(s) determined on the basis of an operation(s) on the fingering key(s) 1, a level or the like of the breath pressure detected by the breath pressure detector 2, and controls the sound output unit 4 and so forth to output a sound of the determined note with a volume for the level or the like of the breath pressure.

[Conversion-to-Note Process and Sound Output Process by Electronic Wind Instrument]

Next, a conversion-to-note method (conversion-to-note process or virtual-tone-hole-and-note correspondence data creation process) according to this embodiment is described with reference to FIG. 4.

Figure 4:
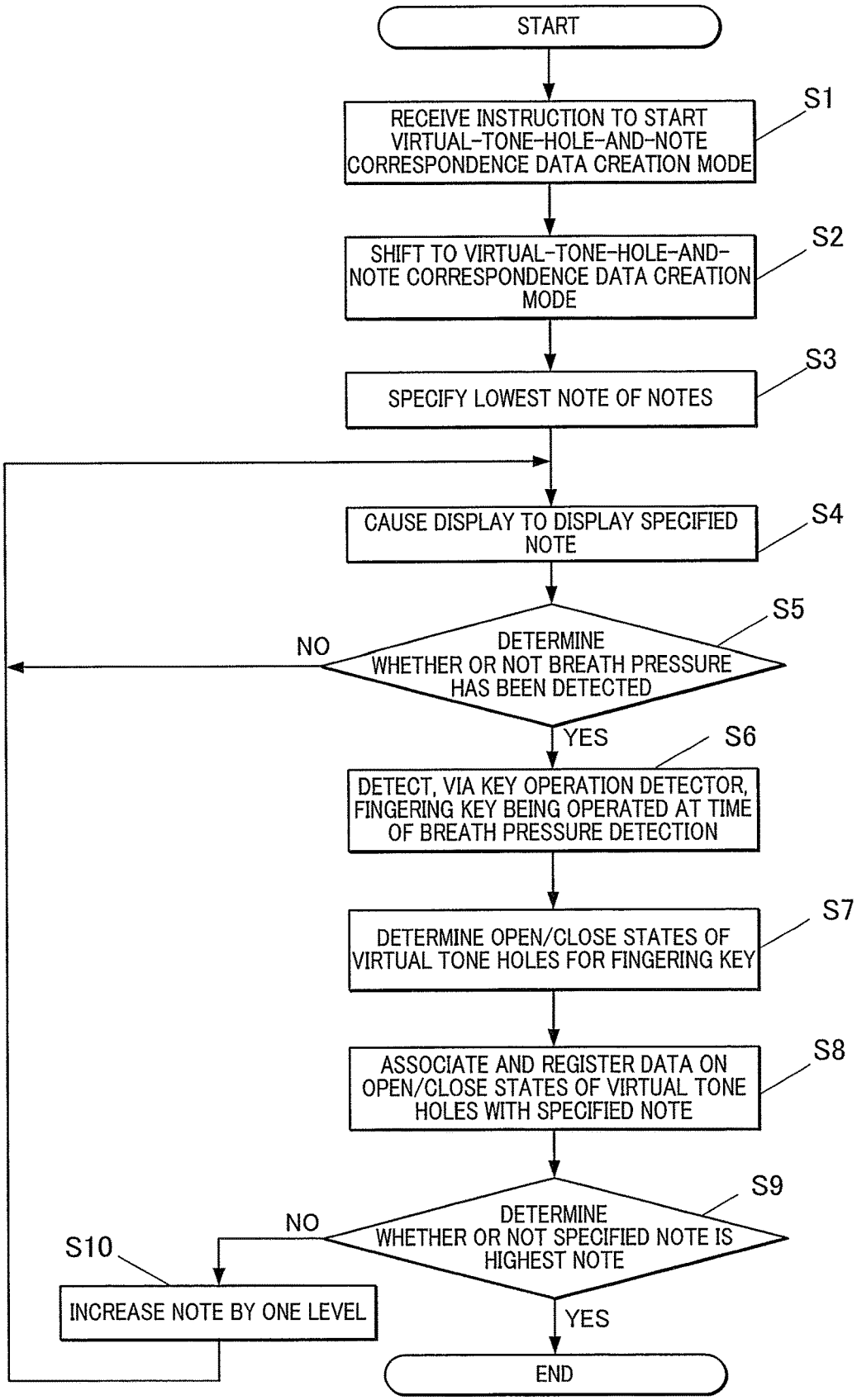
FIG. 4 is a flowchart showing a virtual-tone-hole-and-note correspondence data creation process according to the embodiment.

As shown in FIG. 4, in this embodiment, when receiving an instruction to start a virtual-tone-hole-and-note correspondence data creation mode (the correspondence setting mode) input by an operation on the operation switch 6 or the like (Step S1), the controller 8 shifts to the virtual-tone-hole-and-note correspondence data creation mode (Step S2).

In the virtual-tone-hole-and-note correspondence data creation mode, first, the controller 8 specifies, in response to a user operation, the lowest note of notes which can be output by the electronic wind instrument 100 of this embodiment (Step S3), and causes the display 3 to display the specified note (Step S4).

The controller 8 determines whether or not the breath pressure detector 2 has detected the breath pressure (Step S5). When determining that the breath pressure detector 2 has not detected the breath pressure (Step S5; NO), the controller 8 returns to and repeats Step S4. When the breath pressure detector 2 has detected the breath pressure which is smaller than a predetermined threshold value, the controller 8 may determine that the breath pressure detector 2 has not detected the breath pressure.

On the other hand, when the controller 8 determines that the breath pressure detector 2 has detected the breath pressure (Step S5; YES), the key operation detector 11 detects the fingering key(s) 1 being operated at the time of the breath pressure detection (Step S6).

Then, the conversion-to-virtual-tone-hole section 81 converts the operation(s) on the fingering key(s) 1 detected by the key operation detector 11 to the open/close states of the virtual tone holes (Step S7). More specifically, the conversion-to-virtual-tone-hole section 81 determines how the open/close state of each virtual tone hole has been changed by the operation(s) on the fingering key(s) 1 with reference to (on the basis of) the virtual tone hole open/close state table 93.

When the conversion-to-virtual-tone-hole section 81 determines the open/close states of all the virtual tone holes (Step S7), the virtual-tone-hole-and-note correspondence creation section 83 associates data on the determined open/close states of all the virtual tone holes with the specified note, and registers the same in the key-operation-and-note correspondence data storage area 92 as a new virtual-tone-hole-and-note correspondence table 94 (Step S8).

The controller 8 determines whether or not it has specified all the notes, which can be output by the electronic wind instrument 100 of this embodiment, up to the highest note (Step S9). When determining that it has specified all the notes (Step S8; YES), the controller 8 finishes the process.

On the other hand, when determining that it has not specified all the notes up to the highest note yet (Step S9; NO), the controller 8 increases the note by one level (e.g. from "do" to "re") (Step S10), and repeats Step S4 and the following steps.

This allows a user to play the electronic wind instrument 100 with his/her desired fingering patterns.

Next, a sound output process which is performed while a user is playing the electronic wind instrument 100 of this embodiment is described with reference to FIG. 5.

Figure 5:
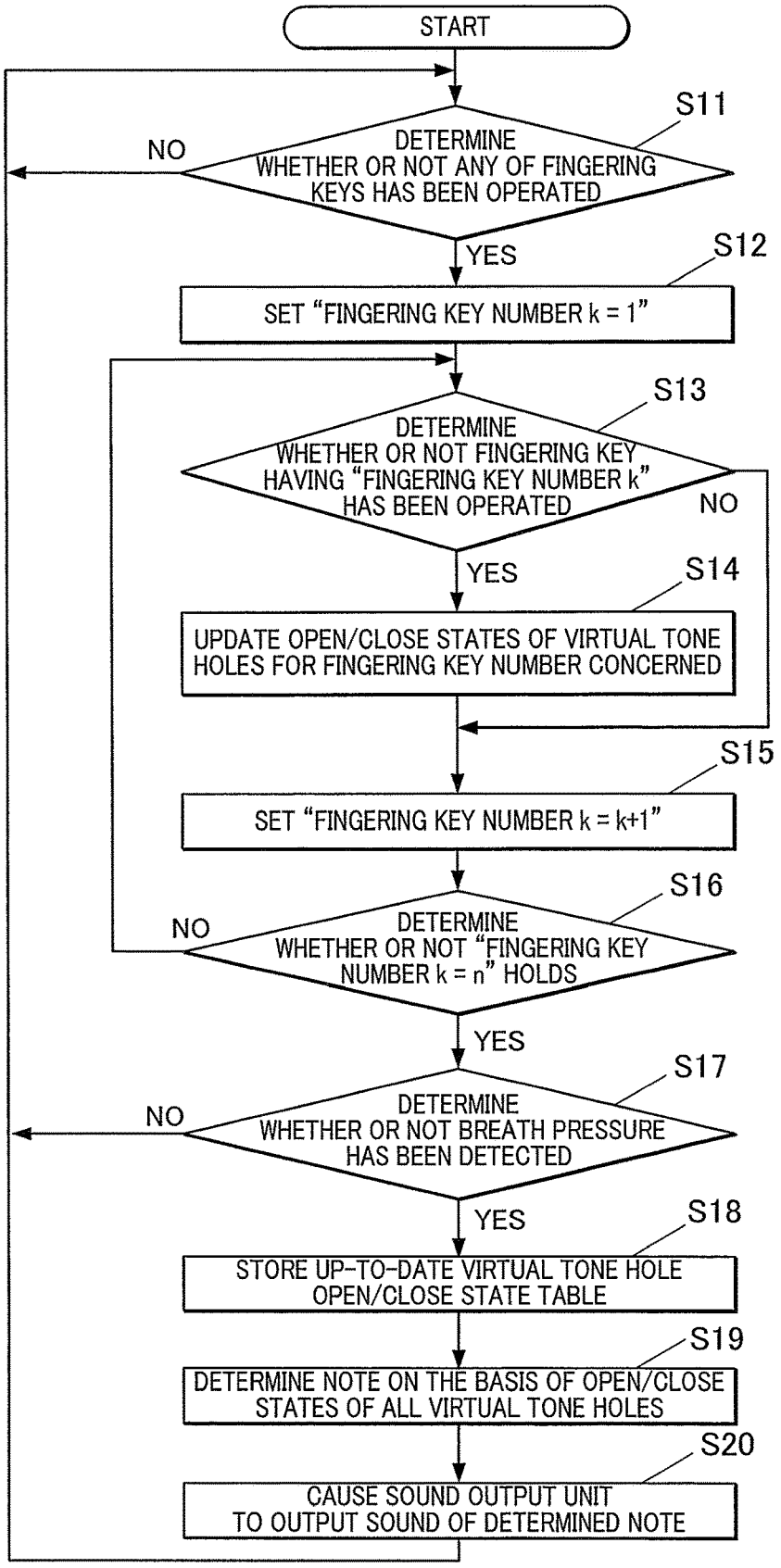
FIG. 5 is a flowchart showing a sound output process by the electronic wind instrument according to the embodiment.

As shown in FIG. 5, the controller 8 determines whether or not the key operation detector 11 has detected an operation(s) on any of the fingering keys 1 (Step S11). When determining that the key operation detector 11 has detected no operation on any of the fingering keys 1 (Step S11; NO), the controller 8 repeats Step S11.

On the other hand, when the controller 8 determines that the key operation detector 11 has detected an operation (s) on one or more fingering keys 1 (Step S11; YES), the conversion-to-virtual-tone-hole section 81 checks, in order, which fingering key (s) 1 has been operated. More specifically, the conversion-to-virtual-tone-hole section 81 sets "fingering key number k=1" (Step S12), and determines whether or not the key operation detector 11 has detected an operation on the fingering key 1 having the "fingering key number k" (i e key no. 1) (Step S13). When determining that the key operation detector 11 has detected an operation on the fingering key 1 having the "fingering key number k" (Step S13; YES), the conversion-to-virtual-tone-hole section 81 refers to the virtual tone hole open/close state table 93, and updates the open/close states of the virtual tone holes for the fingering key number k concerned (here "k=1") to those after the operation on the fingering key 1 (Step S14).

On the other hand, when determining that the key operation detector 11 has detected no operation on the fingering key 1 having the "fingering key number k" (Step S13; NO), or when determining that the key operation detector 11 has detected an operation on the fingering key 1 having the "fingering key number k" (Step S13; YES) and updating the open/close states of the virtual tone holes for the fingering key 1 (Step S14), the conversion-to-virtual-tone-hole section 81 sets "fingering key number k=k+1" (Step S15), and determines whether or not "k=n", namely, "k=k+1=n", holds (Step S16). More specifically, in the case where the number of the fingering keys 1 is n, and accordingly the fingering keys 1 having the "key no. 1" to "key no. n" are present, in Step S16, the conversion-to-virtual-tone-hole section 81 determines whether or not it has checked all the fingering keys 1 about being operated or not (Step S16).

When determining that it has not yet finished checking all the fingering keys 1 about being operated or not (Step S16; NO), the conversion-to-virtual-tone-hole section 81 returns to Step S13 and repeats Step S13 and the following steps for the "fingering key number k=k+1".

The determination about which fingering key (s) 1 has been operated is made promptly, for example, by timer interrupt or regular tasking performed with respect to all the fingering keys 1, and the conversion-to-virtual-tone-hole section 81 regularly updates contents of the virtual tone hole open/close state table 93 to the latest version at all times in response to the operations on the fingering keys 1.

When determining that it has finished checking all the fingering keys 1 about being operated or not (Step S16; YES), the conversion-to-virtual-tone-hole section 81 determines whether or not the breath pressure detector 2 has detected the breath pressure (Step S17). When determining that the breath pressure detector 2 has not detected the breath pressure (or has detected the breath pressure which is smaller than a predetermined threshold value) (Step S17; NO), the controller 8 returns to Step S11 to repeat the process.

On the other hand, when determining that the breath pressure detector 2 has detected the breath pressure (Step S17; YES), the conversion-to-virtual-tone-hole section 81 fixes the open/close states of all the virtual tone holes in their latest states, and stores this up-to-date virtual tone hole open/close state table 93 in the key-operation-and-note correspondence data storage area 92 (Step S18).

Further, when the conversion-to-virtual-tone-hole section 81 determines that the breath pressure detector 2 has detected the breath pressure (Step S17; YES), the note determination section 82 determines a note with reference to (on the basis of) the virtual tone hole open/close state table 93 updated by the conversion-to-virtual-tone-hole section 81 and the virtual-tone-hole-and-note correspondence table 94 (Step S19).

Then, the sound output control section 84 causes the sound output unit 4 to output a sound of the note determined by the note determination section 82 (Step S20).

Once the sound output control section 84 causes the sound output unit 4 to output the sound (Step S20), the controller 8 returns to Step S11 to repeat the play process (sound output process). If the power switch 5 is turned off, or no operation on any of the fingering keys 1 or no breath pressure is detected for a certain period of time, the play process may automatically end after a preset/predetermined period of time.

Thus, notes of sounds to be output are determined on the basis of the virtual tone hole open/close state table 93 and the virtual-tone-hole-and-note correspondence table 94. Hence, the electronic wind instrument 100 can be played by using various fingering patterns although the data amount therefor is relatively small.

As described above, according to this embodiment, an operation(s) on the fingering key(s) 1 is detected, and the conversion-to-virtual-tone-hole section 81 converts the operation on the fingering key 1 to the open/close states of the virtual tone holes, referring to the virtual tone hole open/close state table 93 as the first information. Further, the note determination section 82 determines a note on the basis of the open/close states of the virtual tone holes, to which the operation on the fingering key 1 has been converted by the conversion-to-virtual-tone-hole section 81, referring to the virtual-tone-hole-and-note correspondence table 94 as the second information.

Thus, the conversion-to-note apparatus 10 of the electronic wind instrument 100 having no concept of tone holes adopts a concept of imaginary tone holes (virtual tone holes), and determines a note by two conversion steps, namely, by converting an operation(s) on the fingering key(s) 1 to the open/close states of the virtual tone holes and converting the open/close states of the virtual tone holes to the note. This can simplify data for determining notes.

In particular, in the virtual tone hole open/close state table 93 as the first information, for each fingering key 1, the open/close states of the virtual tone holes which are not opened or closed (not affected) by an operation on the fingering key 1 (i.e. which depend on an operation on another fingering key 1 and are the default open/close states if not affected by an operation on any of the fingering keys 1) are all indicated by "x", and only the open/close states of the virtual tone holes which are opened or closed (changed) by the operation on the fingering key 1 are expressed by "0" or "1". This can reduce the data amount as compared with a case where, for all the pairs (combinations) of the virtual tone holes and the fingering keys 1, the open/close states are expressed by "0" or "1".

This can reduce the capacity of a memory to be prepared as the storage 9, and also can increase processing speed.

Consequently, even if a countless number of fingering patterns of alternate fingerings are present, a large number of the fingering patterns can be covered, and accordingly a variety of music performances can be enjoyed, as with an acoustic wind instrument.

Further, according to this embodiment, the conversion-to-note apparatus 10 has the correspondence setting mode in which correspondences between operations on the fingering keys 1 and notes of musical tones to be output by (in response to) the operations are set, and if an operation to specify a note and an operation(s) on the fingering key(s) 1 are performed, the processor associates the open/close states of the virtual tone holes for the operation(s) on the fingering key(s) 1 with the note, thereby creating the virtual-tone-hole-and-note correspondence table 94 as virtual-tone-hole-and-note correspondence data.

This allows a user to play the electronic wind instrument 100 by choosing fingering patterns from among the fingering patterns of various alternate fingerings in addition to the basic fingering patterns according to his/her habit, fingering for a piece of music and so forth, as with an acoustic wind instrument.

Further, because the tone holes of the electronic wind instrument 100 are virtual, combinations of the open/close states of the tone holes and notes, the combinations not existing in an acoustic wind instrument, can be set. Consequently, fingering patterns can be customized to user's preference by registering user's desired fingering patterns.

Further, according to this embodiment, the electronic wind instrument 100 includes the breath pressure detector 2 as the operation fixing unit which fixes operations on the fingering keys 1. When the breath pressure detector 2 fixes operations on the fingering keys 1, the operation detector 11 detects the operations on the fingering keys 1.

This can prevent user's unintended operation of the electronic wind instrument 100 from occurring when the user presses wrong fingering keys 1 or presses the fingering keys 1 by mistake. For example, this can prevent sounds or the registration process from being output or performed unexpectedly.

Further, the electronic wind instrument 100 of this embodiment includes: the conversion-to-note apparatus 10; the breath pressure detector 2 which is a blowing pressure sensor that detects the blowing pressure of the breath into the instrument body of the electronic wind instrument 100 via the mouthpiece; the fingering keys 1; the sound data storage area 95 which is a sound data storage that stores sound data; the sound output control section 84 which generates, on the basis of the sound data stored in the sound data storage area 95, musical tone output data for outputting a musical tone of a note determined by the note determination section 82; and the sound output unit 4 which outputs the musical tone on the basis of the musical tone output data generated by the sound output control section 84 if the breath pressure detector 2 detects the blowing pressure.

Consequently, while a conventional electronic wind instrument has a countless number of fingering patterns and requires a complex note identification process, the electronic wind instrument 100 can relatively easily identify notes perform the registration process of new fingering patterns, for example. Accordingly, the electronic wind instrument 100 can be realized as a more-acoustic-wind-instrument-like electronic wind instrument which a user can freely play with his/her preference, habit and so forth reflected.

Although an embodiment of the present invention is described above, needless to say the present invention is not limited to the embodiment and can be appropriately modified in a variety of aspects without departing from the scope of the present invention.

For example, in the embodiment, the breath pressure detector 2 functions as the operation fixing unit which fixes operations on the fingering keys 1. However, the operation fixing unit is not limited to the breath pressure detector 2 as far as it can identify, on the basis of an operation. (s) with a part of the body of a user other than fingers, timings at which operations on the fingering keys 1 are fixed.

For example, a touch sensor, such as a lip sensor which detects a lip touching a mouthpiece, may be used. Because operations on the fingering keys 1 are fixed in the state in which the fingering keys 1 are pressed (operated) with fingers, it is difficult to fix the operations with a hand. The operations may therefore be fixed by detection of another part of the body of a user touching a part of the electronic wind instrument 100, for example.

Further, in this embodiment, the imaginary tone holes (virtual tone holes) are regarded as tone holes. However, if a musical instrument or the like in which the conversion-to-note apparatus 10 is installed has physical tone holes, the above processes may be performed on the basis of the open/close states of these tone holes. In this case, the first information is a tone hole open/close state table which indicates the open/close states of the actual tone holes, and the second information is a correspondence table in which the open/close states of the actual tone holes are associated with notes.

What is claimed is:

1. A conversion-to-note apparatus comprising:

a key which is operable by a user; and a processor which:

obtains, from a memory, (i) first information for associating a detected key operation on the key with an open/close state of a tone hole or virtual tone hole, and (ii) second information for associating the open/close state of the tone hole or virtual tone hole with a note;

identifies, based on the first information, the open/close state of the tone hole or virtual tone hole for the detected key operation; and determines, based on the second information, the note for the identified open/close state of the tone hole or virtual tone hole, wherein the first information stored in the memory comprises information which indicates, for each of pairs of keys including the key and tone holes or virtual tone holes including the tone hole or virtual tone hole, which of an open state, a close state, and a dependent open/close state should be the open/close state of a tone hole or virtual tone hole in the pair when a key in the pair of keys is operated, wherein the dependent open/close state indicates a state in which the tone hole or virtual tone hole is in the open state or the close state depending on a key operation on another key, and wherein the processor determines the open/close states of respective tone holes or virtual tone holes based on open/close states stored, in the first information, for the detected key operation.

2. The conversion-to-note apparatus according to claim 1, wherein the processor:

detects key operations on keys including the key;

determines a note for the keys for which the key operations have been detected, based on the first information and the second information; and performs control to produce a sound of the determined note.

3. The conversion-to-note apparatus according to claim 1, wherein the processor, in response to detecting key operations on plural keys, determines the open/close states of the respective tone holes or virtual tone holes based on a change to the open state or the close state specified and stored, in the first information, for any of the plural keys.

4. The conversion-to-note apparatus according to claim 3, wherein when the open/close state of any of the tone holes or virtual tone holes stored, in the first information, for each of the plural keys, is the dependent open/close state, the processor determines an open/close state predetermined for the tone hole or virtual tone hole as a state to which the open/close state of the tone hole or virtual tone hole should be changed.

5. The conversion-to-note apparatus according to claim 1, wherein the conversion-to-note apparatus is operable in a setting mode in which a correspondence between a key operation and a note of a musical tone is set, and wherein the processor, in response to an operation to specify the note and the key operation being performed in the setting mode, associates the open/close state of the tone hole or virtual tone hole with the specified note, thereby creating the second information, the key operation being converted to the open/close state of the tone hole or virtual tone hole based on the first information.

6. The conversion-to-note apparatus according to claim 1, wherein the processor:

detects a fixing operation which fixes the key operation; and in a state in which the key operation is fixed by the fixing operation, converts the key operation to the open/close state of the tone hole or virtual tone hole, and determines the note.

7. The conversion-to-note apparatus according to claim 6, wherein the processor identifies a timing of the fixing operation based on an operation with a part of a body of the user other than a finger.

8. The conversion-to-note apparatus according to claim 6, wherein the processor creates or edits the second information based on a user operation.

9. An electronic wind instrument comprising:

the conversion-to-note apparatus according to claim 1;

a blowing pressure sensor which detects a blowing pressure of breath into the electronic wind instrument via a mouthpiece;

a plurality of fingering keys;

a sound data storage which stores sound data; and a sound output unit which outputs a musical tone, wherein the processor:

determines a note according to key operations on the fingering keys;

generates, based on the sound data stored in the sound data storage, musical tone output data for the determined note; and causes the sound output unit to output the musical tone based on the generated musical tone output data, when the blowing pressure sensor detects the blowing pressure.

10. A conversion-to-note method for an apparatus to perform a control process comprising:

detecting a key operation on a key;

identifying, based on first information for associating a detected key operation with an open/close state of a tone hole or virtual tone hole, the open/close state of the tone hole or virtual tone hole for the detected key operation; and determining, based on second information for associating the open/close state of the tone hole or virtual tone hole with a note, the note for the identified open/close state of the tone hole or virtual tone hole, wherein the first information comprises information which indicates, for each of pairs of keys including the key and tone holes or virtual tone holes including the tone hole or vertical tone hole, which of an open state, a close state, and a dependent open/close state should be the open/close state of a tone hole or virtual tone hole in the pair when a key in the pair of keys is operated, wherein the dependent open/close state indicates a state in which the tone hole or virtual tone hole is in the open state or the close state depending on a key operation on another key, and wherein the control process comprises determining the open/close states of respective tone holes or virtual tone holes based on the open/close states stored, in the first information, for the detected key operation.

11. The conversion-to-note method according to claim 10, wherein the control process comprises:

detecting key operations on keys including the key;

determining a note for the keys for which the key operations have been detected, based on the first information and the second information; and performing control to produce a sound of the determined note.

12. The conversion-to-note method according to claim 10, wherein the control process comprises, in response to detecting key operations on plural keys, determining the open/close states of the respective tone holes or virtual tone holes based on a change to the open state or the close state specified and stored, in the first information, for any of the plural keys.

13. The conversion-to-note method according to claim 12, wherein the control process comprises, when the open/close state of any of the tone holes or virtual tone holes stored, in the first information, for each of the plural keys, is the dependent open/close state, determining an open/close state predetermined for the tone hole or virtual tone hole as a state to which the open/close state of the tone hole or virtual tone hole should be changed.

14. The conversion-to-note method according to claim 10, wherein:

the apparatus is operable in a setting mode in which a correspondence between a key operation and a note of a musical tone is set, and the control process comprises, in response to an operation to specify the note and the key operation being performed in the setting mode, associating the open/close state of the tone hole or virtual tone hole with the specified note, thereby creating the second information, the key operation being converted to the open/close state of the tone hole or virtual tone hole based on the first information.

15. A non-transitory computer readable storage medium storing a program to cause a computer to perform a control process comprising:

detecting a key operation on a key;

identifying, based on first information for associating a detected key operation with an open/close state of a tone hole or virtual tone hole, the open/close state of the tone hole or virtual tone hole for the detected key operation; and determining, based on second information for associating the open/close state of the tone hole or virtual tone hole with a note, the note for the identified open/close state of the tone hole or virtual tone hole, wherein the first information comprises information which indicates, for each of pairs of keys including the key and tone holes or virtual tone holes including the tone hole or vertical tone hole, which of an open state, a close state, and a dependent open/close state should be the open/close state of a tone hole or virtual tone hole in the pair when a key in the pair of keys is operated, wherein the dependent open/close state indicates a state in which the tone hole or virtual tone hole is in the open state or the close state depending on a key operation on another key, and wherein the control process comprises determining the open/close states of respective tone holes or virtual tone holes based on open/close states stored, in the first information, for the detected key operation.

* * * * *